US010206261B2

(12) United States Patent
Wang et al.

(10) Patent No.: US 10,206,261 B2
(45) Date of Patent: Feb. 12, 2019

(54) LED CIRCUIT WITH COLOR TEMPERATURE ADJUSTMENT

(71) Applicant: XIAMEN ECO LIGHTING CO. LTD., Xiamen (CN)

(72) Inventors: Qiyuan Wang, Xiamen (CN); Wenchang Huang, Xiamen (CN); Guangai Chen, Xiamen (CN); Huiwu Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/481,180

(22) Filed: Apr. 6, 2017

(65) Prior Publication Data

US 2018/0249547 A1 Aug. 30, 2018

(30) Foreign Application Priority Data

Feb. 28, 2017 (CN) ..... 2017 1 01134736

(51) Int. Cl.
*H05B 33/08* (2006.01)
*H05B 37/02* (2006.01)

(52) U.S. Cl.
CPC ..... *H05B 33/0857* (2013.01); *H05B 33/083* (2013.01); *H05B 33/0806* (2013.01); *H05B 33/0821* (2013.01); *H05B 33/0827* (2013.01); *H05B 33/0845* (2013.01); *H05B 37/0272* (2013.01)

(58) Field of Classification Search
CPC ..... H05B 33/0827; H05B 33/083; H05B 33/0815; H05B 33/0857; H05B 33/0812; H05B 33/0845; H05B 33/086; H05B 33/0824; H05B 33/0806; H05B 33/0809; H05B 33/0821; H05B 33/0833; H05B 33/0842; H05B 33/0881; H05B 33/00; H05B 33/089
See application file for complete search history.

(56) References Cited

U.S. PATENT DOCUMENTS 7,408,308 B2 * 8/2008 Sawada ..... H05B 33/0815 315/169.1
7,902,761 B2 * 3/2011 Ang ..... H05B 33/0809 315/194
8,102,167 B2 * 1/2012 Irissou ..... H05B 39/02 315/194

(Continued)

*Primary Examiner* — Vibol Tan
(74) *Attorney, Agent, or Firm* — Chun-Ming Shih

(57) ABSTRACT

An LED circuit with color temperature adjustment comprises a first LED string, a resistor, and a second LED string. The first LED string has a first color temperature. The resistor is connected in series with the first string. The second LED string has a second color temperature. The first LED string is connected in parallel with the second LED string. The second color temperature is higher than the first color temperature. The integrated color temperature of the first LED string and the second LED string increases when the total current of the first LED string and the second LED string increases. The present disclosure not only can provide an LED circuit with color temperature adjustment, but also can provide an LED circuit which can adjust the color temperature by the combinations of the LED strings connected in parallel or series.

9 Claims, 15 Drawing Sheets

(56) References Cited

U.S. PATENT DOCUMENTS

| | | | | |
|---|---|---|---|---|
| 8,134,304 | B2 * | 3/2012 | Hsu | H05B 33/0815 315/169.1 |
| 8,159,125 | B2 * | 4/2012 | Miao | F21K 9/00 313/498 |
| 8,384,305 | B2 * | 2/2013 | Liao | H02M 3/33507 315/294 |
| 8,587,205 | B2 * | 11/2013 | Ter Weeme | H05B 33/0815 315/113 |
| 9,439,250 | B2 * | 9/2016 | Lee | H05B 33/0815 |
| 2013/0211608 | A1 * | 8/2013 | Farrell | G06F 1/26 700/286 |
| 2015/0054417 | A1 * | 2/2015 | Lee | H05B 37/0272 315/201 |
| 2017/0048941 | A1 * | 2/2017 | Kondo | F21K 9/232 |

* cited by examiner

300

400

LED CIRCUIT WITH COLOR TEMPERATURE ADJUSTMENT

FIELD OF THE INVENTION

The present disclosure relates to an LED circuit, and more particularly to an LED circuit with color temperature adjustment.

BACKGROUND OF THE INVENTION

Color temperature is a physical quantity used in lighting optics for defining the color of the light source. The color temperature is defined as follows: heating a black-body to a certain temperature, when the color of the emitted light is the same as the color of the light emitted by a light source, the temperature of the black-body heating is called the color temperature of the light source, color temperature for short. The unit is expressed in "K" (Kelvin temperature unit). For general people, a low color temperature light source is usually called warm color, generally appeared as red, yellow or orange. A high color temperature light source is usually called cold color, generally appeared as blue or purple. The color temperature of some common light source, for example, standard candle is 1930K (Kelvin temperature unit); tungsten wire is 2760-2900K; fluorescent lamp is 6400K; flash is 3800K; noon sun is 5000K; electronic flash is 6000K; blue sky is 10000K.

Modern lighting equipment has evolved into being made of LED. Many are composed of LED string. The present white LEDs mostly are made by coating a layer of pale yellow phosphor on a blue LED (near-UV, wavelength is from 450 nm to 470 nm). LED string emit first, and then illuminate to the phosphor, so that it looks white. However, if the product design specifications require a certain stable color temperature, or a particular color temperature curve, for LED string designers, it will be an important challenge. The entire LED industry needs an LED with adjustable color temperature, to allow designers to design and manufacture high-quality adjustable color temperature LED string easily. In addition, for the natural light, the color temperature often changes as the brightness. How to reduce cost and simulate natural light have always been a technical challenge.

SUMMARY OF THE INVENTION

One object of the present disclosure is to provide an LED circuit with color temperature adjustment. Another object of the present disclosure is to provide an LED circuit which can adjust the color temperature by the combination of the LED strings connected in parallel and series. Still another object of the present disclosure is to provide an LED circuit which can simulate natural light color temperature.

The first embodiment of the instant disclosure provides an LED circuit capable of adjusting the color temperature. The LED circuit comprises a first LED string, a resistor, and a second LED string. The first LED string has a first color temperature. The resistor is connected in series with said first string. The second LED string has a second color temperature. The first LED string is connected in parallel with the second LED string. The second color temperature is higher than said first color temperature. Wherein the integrated color temperature of the first LED string and the second LED string increases when the total input current of the first LED string and the second LED string increases.

The second embodiment of the instant disclosure provides an LED circuit capable of adjusting the color temperature.

The LED circuit comprises a first LED string, a first regulator module, a first switch assembly, a second LED string, a second regulator module, and a second switch assembly. The first LED string has a first color temperature. The second LED string has a second color temperature. The second color temperature is higher than said first color temperature. The first regulator module provides a first current to the first LED string. The first switch assembly is connected between the first LED string and the first regulator module. The second regulator module provides a second current to the second LED string. The second switch assembly is connected between the second LED string and the second regulator module. The first switch assembly is capable of turning on and off independent of the second switch assembly.

The third embodiment of the instant disclosure provides an LED circuit capable of adjusting the color temperature. The LED circuit comprises a first LED string group, a second LED string group, and a switch assembly. The first LED string group comprises a first LED string and a second LED string. Both the first LED group and the second LED group have a first color temperature. The second LED string group comprises a third LED string and a forth LED string. Both the third LED string and the forth LED string have the second color temperature. The switch assembly controls a serial or parallel connection of the first LED string and the second LED string. The switch assembly controls a serial or parallel connection of the third LED string and the forth LED string. The second color temperature is higher than the first color temperature.

The forth embodiment of the instant disclosure provides an LED circuit capable of adjusting the color temperature. The LED circuit comprises a first LED string group, a second LED string group, and a switch assembly. The first LED group comprises a first LED string and a second LED string. The first LED string has a first color temperature. The second LED string has a second color temperature. The second LED string group comprises a third LED string and a forth LED string. The third LED group has a third color temperature. The forth LED string has a forth color temperature. The switch assembly controls a serial or parallel connection of the first LED string and the second LED string. The switch assembly controls a serial or parallel connection of the third LED string and the forth LED string. Wherein the first color temperature is different from the second color temperature. The third color temperature is different from the fourth color temperature.

DETAILED DESCRIPTION OF THE INVENTION

Figure 1:
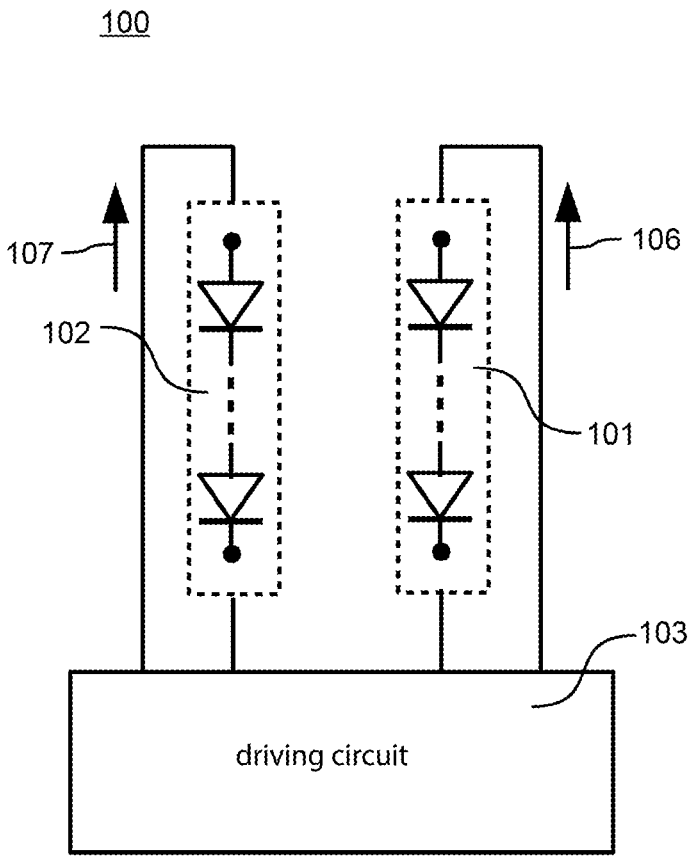
FIG. 1 illustrates an LED circuit with color temperature adjustment according to an embodiment of the present disclosure.
Figure 2:
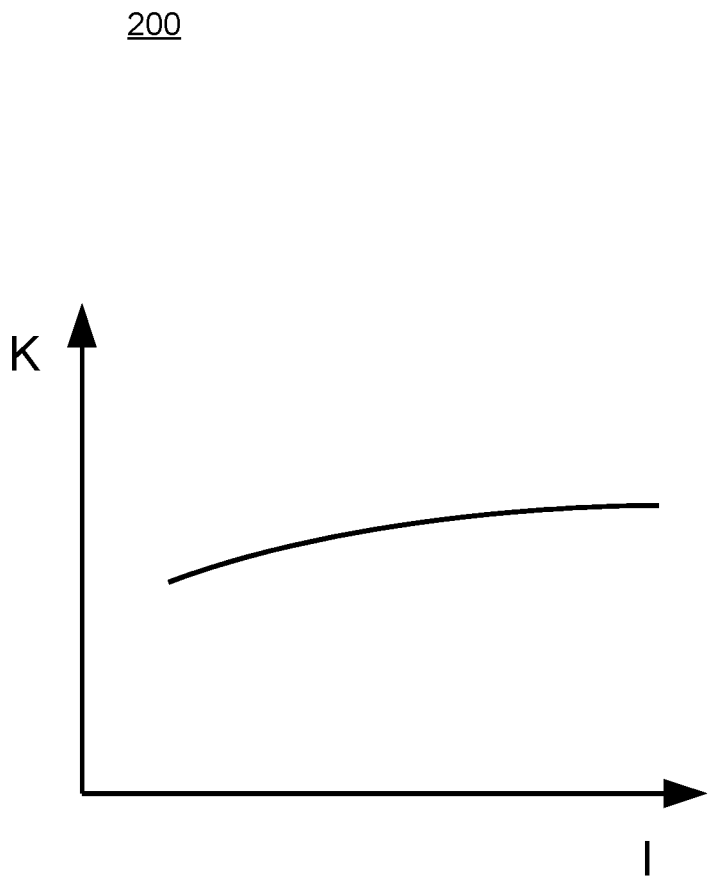
FIG. 2 illustrates a current-color temperature curve of an LED string according to an embodiment of the present disclosure.
Figure 3:
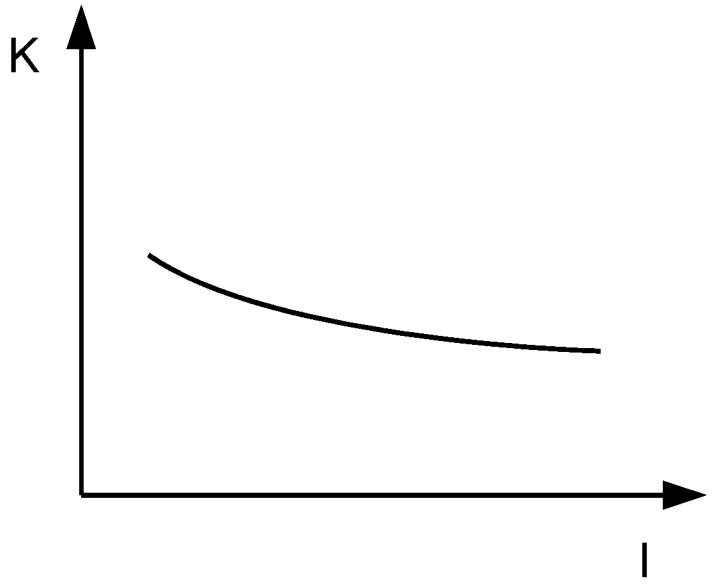
FIG. 3 illustrates a current-color temperature of another LED string according to the embodiment of the present disclosure.

FIG. 1 illustrates an LED circuit with color temperature adjustment. Referring to FIG. 1, LED circuit 100 comprises a first LED string 101, a second LED string 102, and a driving circuit 103. The driving circuit 103 provides a first current 106 for the first LED string 101, and the driving circuit 103 provides a second current 107 for the second LED string. The first LED string 101 has a first color temperature and the second LED string 102 has a second color temperature. FIG. 2 illustrates a current-color temperature curve of an LED string. FIG. 3 illustrates a current-color temperature curve of another LED string. Referring to FIG. 2, the first LED string 101 has a current-color temperature curve 200. For the same LED string 101, although the color temperature will change with the current, the change range will not be too much. In one embodiment, the color temperature of the LED string 101 is around 2200K. The second LED string 102 has a current-color temperature curve 300. In one embodiment, the color temperature of the LED string 102 is around 3000K. The curve 200 is slightly concave upward. The curve 300 is slightly concave downward.

Figure 4:
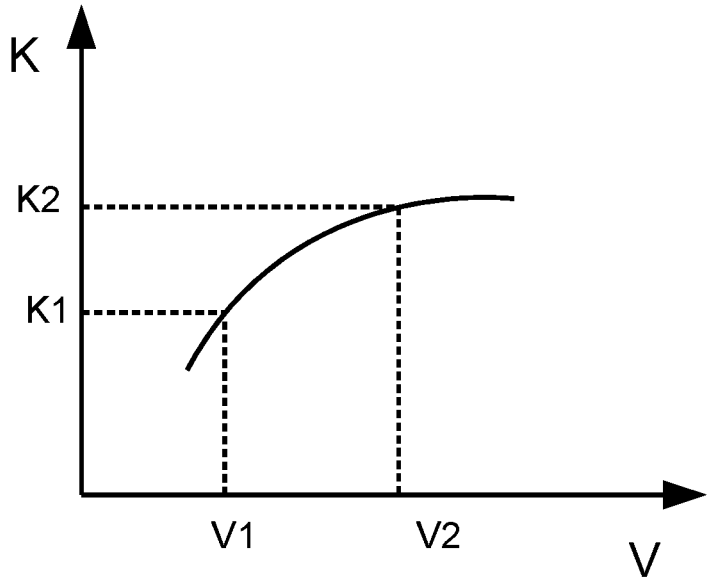
FIG. 4 illustrates an LED circuit with color temperature adjustment according to another embodiment of the present disclosure.
Figure 5:
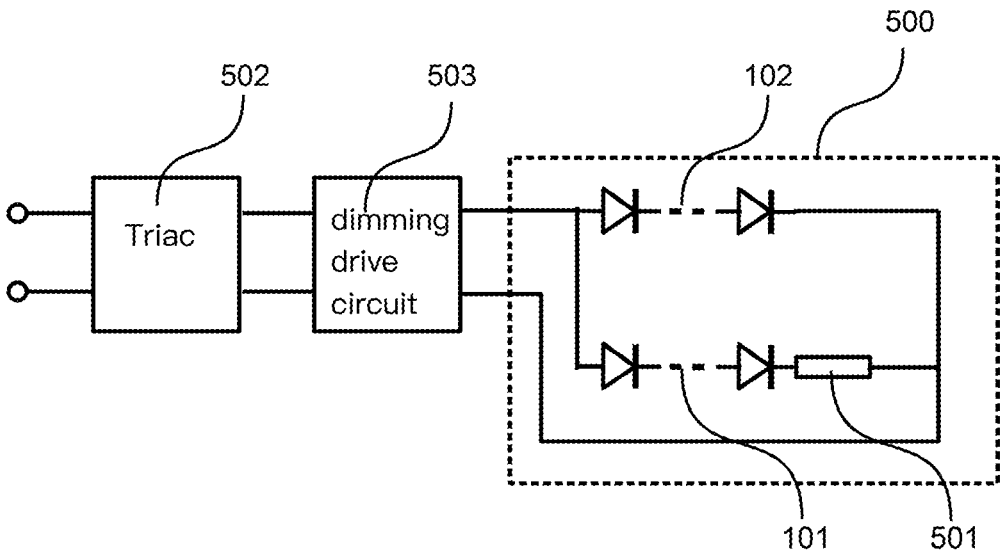
FIG. 5 illustrates an integrated color temperature curve which is obtained after adopting LED strings with different color temperatures in FIG. 4 and then mixing the terminal voltage of the second LED string according to another embodiment of the present disclosure.

FIG. 4 is an embodiment of LED circuit with color temperature adjustment. Referring to FIG. 4, in some embodiments, the first LED string 101 represents a lower color temperature 2200K, the second LED string 102 represents a higher color temperature 3000K. When the terminal voltage of the second LED string 102 is small, the junction voltage of the LED string 101 is low and will be conducted first so that the light emitted by the entire lamp is dominated by the first LED string 101, while the second LED string 102 is turned off at that time. When the terminal voltage of the second LED string 102 is increased and met the turn-on condition, the 3000K light emitted by the second LED string 102 is mixed with 2200K light, so that the overall light color temperature is increased. If the terminal voltage of the second LED string is further increased, the current of the second LED string increases faster compared with the current of the first LED string because of the series connected resistor. In this way, the overall color temperature of the light emitted continues to increase, but the overall output of the maximum color temperature will not reach 3000K. This is because the light emitted by the first LED string 101 always exists, and forms a certain percentage. FIG. 5 illustrates an integral color temperature curve which is obtained after adopting LED strings with different color temperature in FIG. 4 and then mixing the terminal voltage of the second LED string. Referring to FIG. 4 and FIG. 5, V represents the terminal voltage of the second LED string 102, and different V will cause the light emitted by the first LED string 101 to be mixed with the light emitted by the second LED string 102 to produce a different color temperature. For example, a smaller voltage V1 will produce a lower color temperature K1, and a higher voltage V2 will produce a higher color temperature K2.

Referring to FIG. 4, in some embodiments, the LED circuit 100 comprises a TRIAC (triode for alternating current) 502, a dimming drive circuit 503, a first LED string 101, a second LED string 102, and a resistor 501. In one embodiment, the resistor 501 is a variable resistor. The input terminal of the TRIAC 502 is an alternating current (AC), and the output terminal is an alternating current after phase cut. According to the degree of the phase cut, the brightness of the integrated LED string assembly 500 can be controlled. In this embodiment, the LED string assembly 500 comprises a first LED string 101, a second LED string 102, and a resistor 501. As the terminal voltage of the second LED string 102 rises gradually, the overall current flowing into the LED string assembly 500 also rises and then the brightness of the string assembly 500 increases. The amount of increased brightness of the first LED string 101 is different from that of the second LED string 102, so that in the mixed state, the overall LED string assembly 500 can gradually increase from an original lower color temperature to a relatively higher color temperature. The color temperature of natural sunshine in the morning is relatively low, which is a yellow tone, but with the rise of the sun, the color temperature gradually increases and becomes close to a white tone. The circuit design can simulate natural light, from a relatively low color temperature, gradually rising to a relatively high color temperature.

Figure 6:
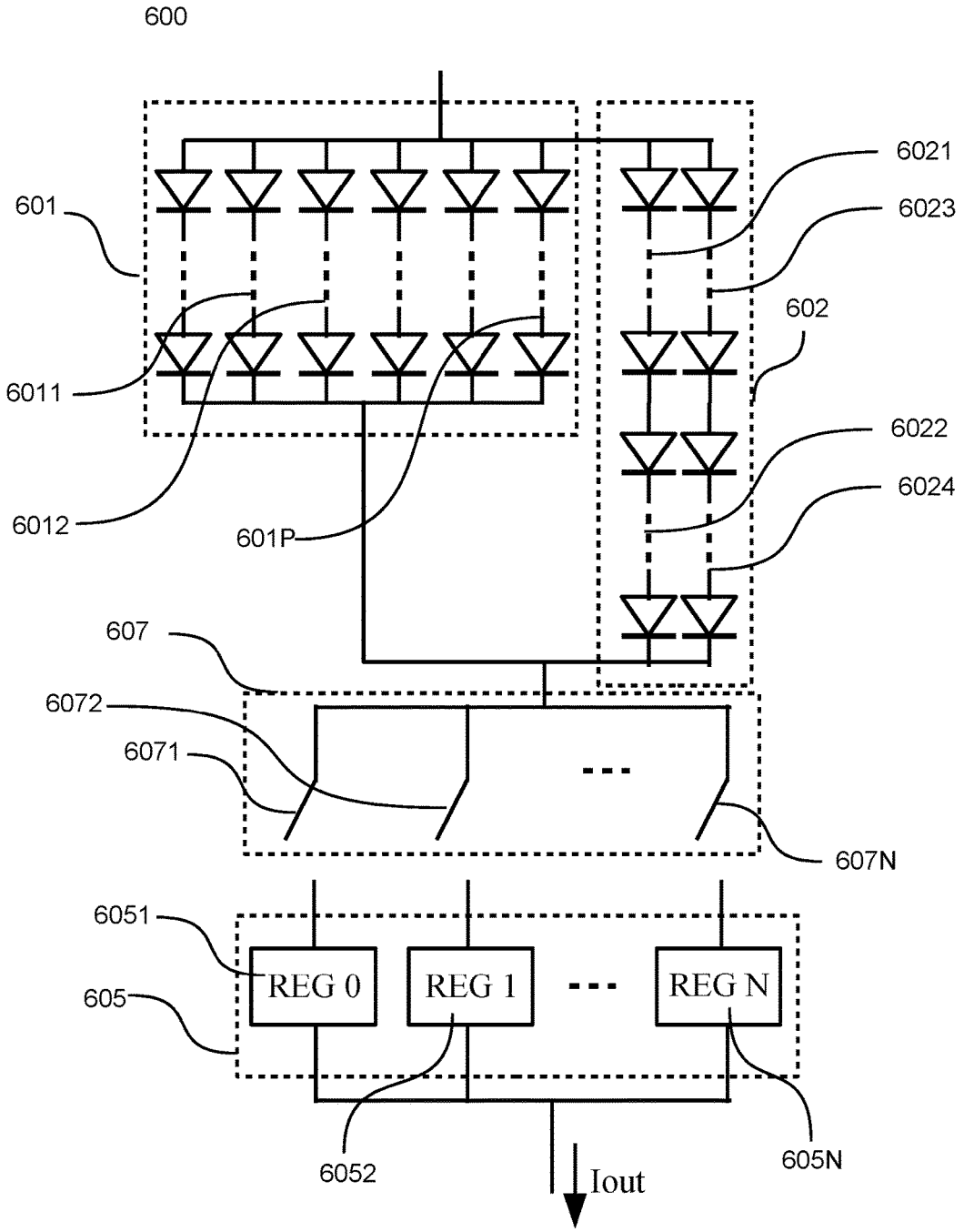
FIG. 6 illustrates an LED circuit with color temperature adjustment according to another embodiment of the present disclosure.

FIG. 6 illustrates another embodiment of the LED circuit with color temperature adjustment. Refer to FIG. 6, the LED circuit 600 comprises a first group of LED strings 601, a second group of LED strings 602, a switch assembly 607, and a regulator module 605. The first group of LED strings 601 comprises a plurality of LED strings, such as LED string 6011, LED string 6012, and LED string 601P. The second group of LED strings 602 also comprises a plurality of LED strings, such as LED string 6021, LED string 6022, LED string 6023, and LED string 6024. The switch assembly 607 comprises a plurality of switches, such as switch 6071, switch 6072, and switch 607N. The regulator module 605 comprises a plurality of regulators, such as regulators 6051, 6052, and 605N. The LED string 6011, the LED string 6012, and the LED string 601P are connected in parallel. The LED string 6021 and LED string 6022 are connected in series. The LED string 6023 and LED string 6024 are connected in series.

In some embodiments, the LED strings within the first group of LED strings 601 have the same color temperature and the LED strings within the second group of LED strings 602 have the same color temperature, but the color temperature of the first group of LED strings 601 and the second group of LED string 602 are different. The number of LED strings within the first group of LED strings 601 and the second group of LED strings 602 may be used as a coefficient for adjusting the overall color temperature. For example, one can set M LED strings in the first group of LED strings 601, and N LED strings in the second group of LED strings 602, and adjust the final color temperature by adjusting the ratio of M to N. Since the LED strings in the first group of LED strings 601 are connected in parallel and the LED strings in the second group of LED strings 602 are connected in series, the turn-on voltage of the first group of LED strings 601 and the second group of LED strings 602 are different. The first group of LED string 601 will first turn on, the second group of LED string 602 will turn on when the voltage is sufficient. In this way, because of the difference voltage, different turn-on conditions, the total inputted current is also different, resulting in different color temperature combination. Designers can deploy a suitable voltage-color temperature curve or current-color temperature curve based on different requirements. In some embodiments, the LED strings within the first group of LED strings 601 have different color temperatures, and the LED strings within the second group of LED strings 602 have different color temperatures. Depending on the ratio of M and N, the final color temperature can also be adjusted.

Figure 7:
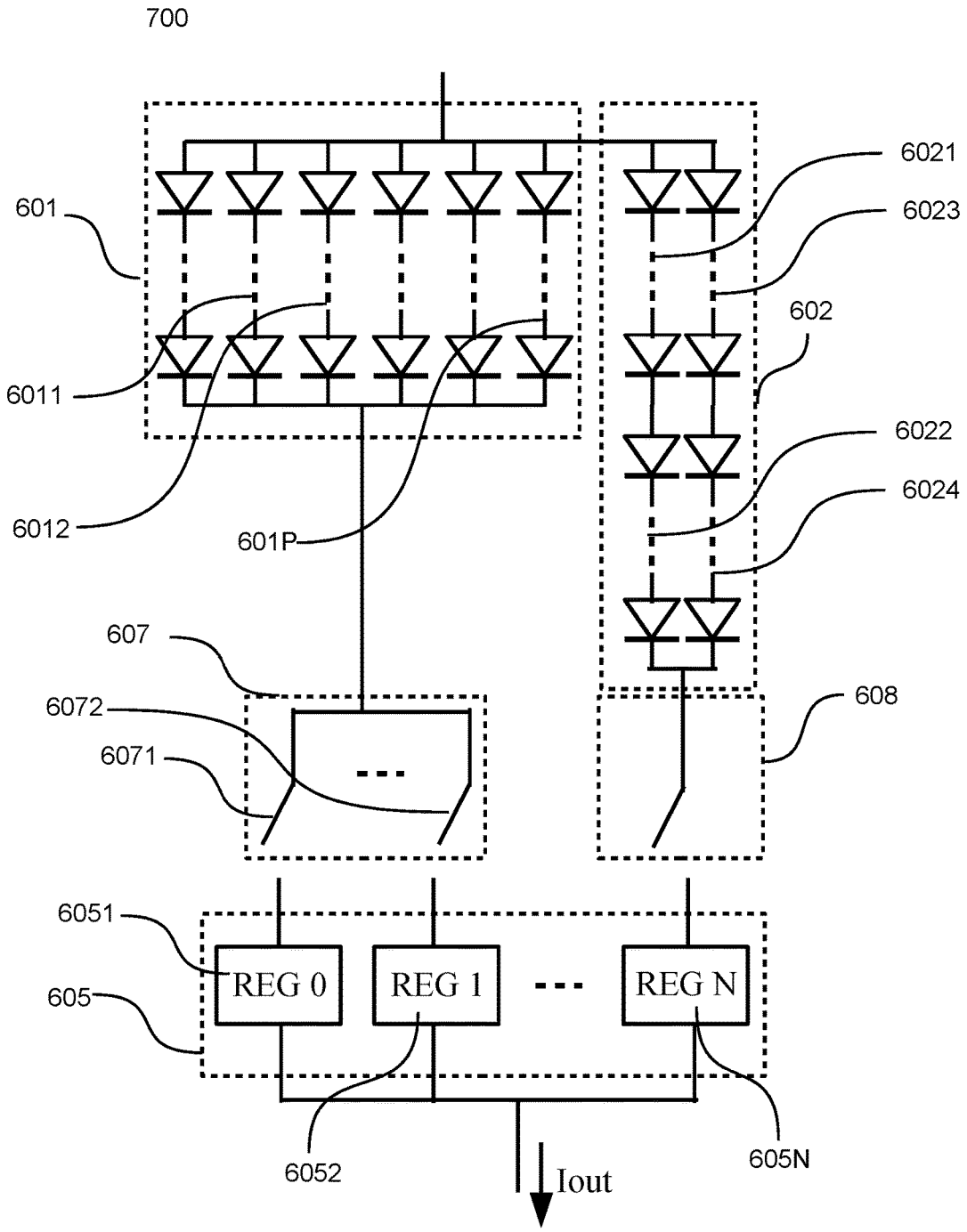
FIG. 7 illustrates an LED circuit with color temperature adjustment according to another embodiment of the present disclosure.

FIG. 7 illustrates another embodiment of the LED circuit with color temperature adjustment. Referring to FIG. 7, LED circuit 700 and LED circuit 600 are mostly the same, except that the LED circuit 700 comprises separated switch assembly 607 and switch assembly 608. By connecting different switch assemblies to different groups of LED string, respectively, one can control the opening or closing of the LED string. For example, the designer may adjust the color temperature by turning on or turning off the switch assembly 607, or by adjusting the opening or closing of the switch assembly 608. In short, separated adjustment of different groups of LED string can be more flexible to adjust the color temperature.

Referring to FIG. 7, in some embodiments, the switch assembly 607 and the switch assembly 608 are used for pulse width modulation. That is, the on and off states of the switch assembly 607 are used to adjust the brightness of the first group of LED strings 601 based on duty cycle. The on and off states of the switch assembly 608 are used to adjust the brightness of the second group of LED strings 602 based on duty cycle. In some embodiments, the duty cycle of the switch assembly 607 and the switch assembly 608 are not the same, that is, the brightness of the first group of LED strings 601 and the second group of LED strings 602 may be adjusted to be different. Since the color temperature of the first group of LED strings 601 and the second group of LED strings 602 are different, the brightness of the first group of LED strings 601 and the second group of LED strings 602 can be freely adjusted. Because the proportions of the color temperatures is different, the designer can adjust any duty cycle to get the final color temperature. In this embodiment, the pulse width modulation of the switch assembly 607 and the switch assembly 608 can be controlled separately. In some embodiments, the LED strings in the first group of LED strings 601 have different color temperatures, and the LED strings in the second group of LED strings 602 have different color temperatures. The final color temperature can also be adjusted depending on the respective pulse width modulation of the switch assembly 607 and the switch assembly 608.

Figure 8:
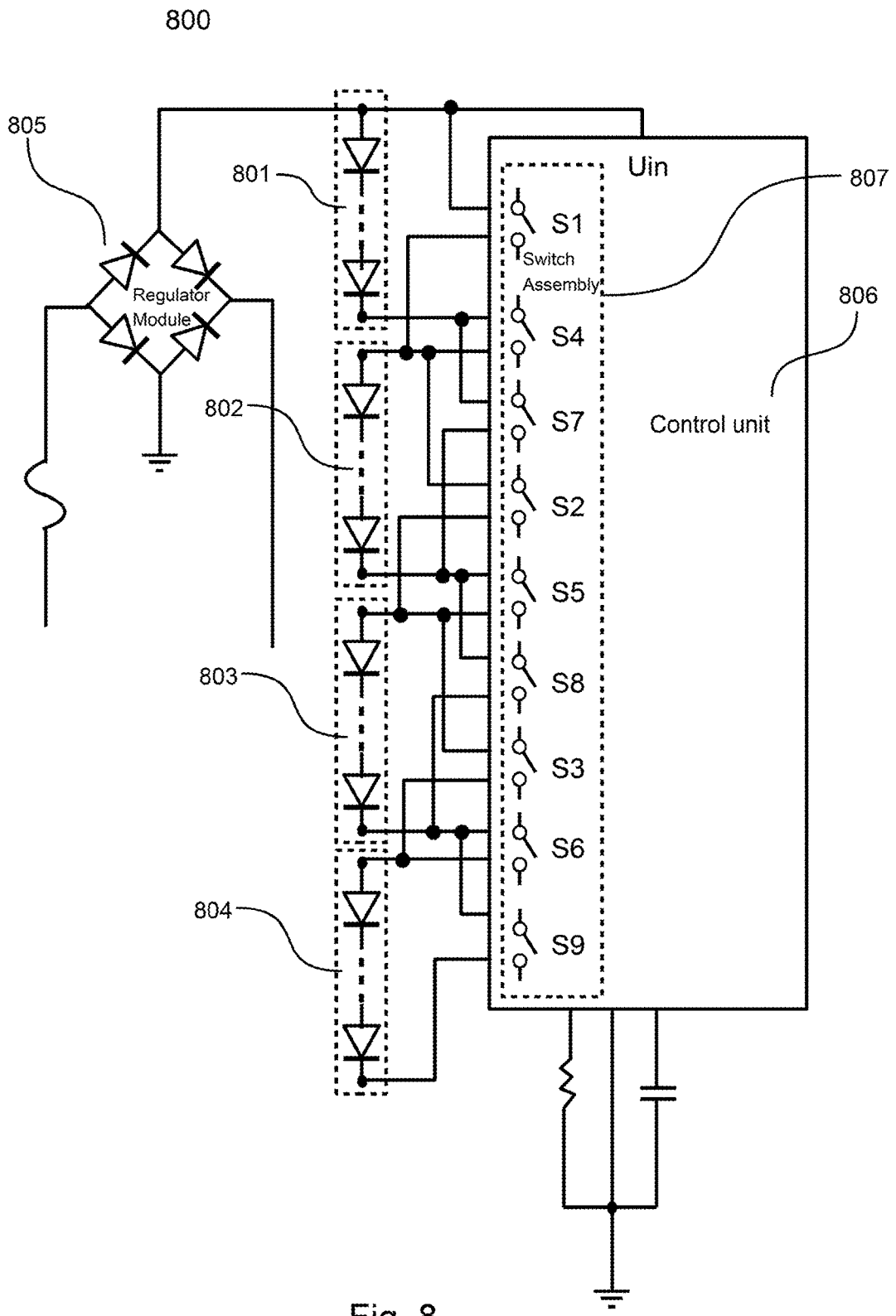
FIG. 8 illustrates an LED circuit with color temperature adjustment according to another embodiment of the present disclosure.

FIG. 8 illustrates another embodiment of the LED circuit with color temperature adjustment. Referring to FIG. 8, in some embodiments, the LED circuit 800 comprises a regulator module 805, a control unit 806, an LED string 801, an LED string 802, an LED string 803, and an LED string 804. The control unit 806 provides the drive current to the LED string 802, the LED string 803, and the LED string 804. In some embodiments, the control unit 806 comprises a switch assembly 807. The switch assembly 807 can control the connection method of the LED string 801, the LED string 802, the LED string 803, and the LED string 804, for example, in parallel or in series. The LED string 801, the LED string 802, the LED string 803, and the LED string 804 may have different color temperatures.

In some embodiments, the switch assembly 807 comprises a first switch S1, a second switch S2, a third switch S3, a fourth switch S4, a fifth switch S5, a sixth switch S6, a seventh switch S7, an eighth switch S8, and a ninth switch S9. When the first switch S1, the second switch S2, the third switch S3, the seventh switch S7, the eighth switch S8, and the ninth switch S9 are closed (connected) and the remaining switches are opened (disconnected), the LED string 801, the LED string 802, LED string 803 and LED string 804 are connected in parallel. When the first switch S1, the third switch S3, the fifth switch S5, the seventh switch S7, and the ninth switch S9 are closed and the second switch S2, the fourth switch S4, the sixth switch S6, and the eighth switch S8 are open, the LED string 801 and the LED string 802 are connected in parallel, the LED string 803 and the LED string 804 also connected in parallel, but the LED string 801 and the LED string 803 are connected in series. In this way, the switch assembly 807 can utilize the closing and opening of the switch to control the parallel or series connection of all LED strings, and the designer can select a suitable combination to get the desired color temperature or current-color temperature curve.

Figure 9:
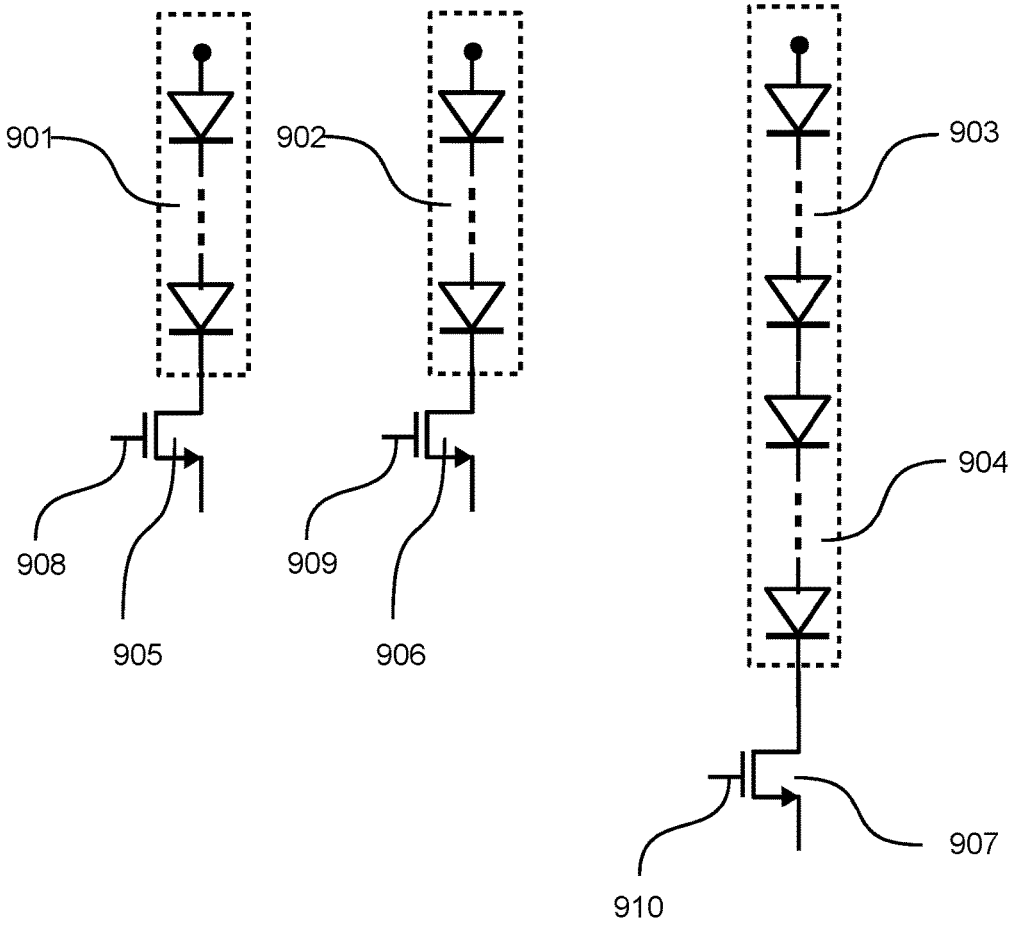
FIG. 9 illustrates an embodiment for controlling the LED string.

FIG. 9 illustrates an embodiment for controlling the LED string. Referring to FIG. 9, the LED string 901 and the LED string 902 are connected in parallel. The LED string 903 and the LED string 904 are connected in series. The transistor 905 provides a current to the LED string 901. The transistor 906 provides a current to the LED string 902. The transistor 907 provides a current to the LED string 903 and the LED string 904. The gate 908, the gate 909, and the gate 910 may control the current magnitude of the transistor 905, the transistor 906, and the transistor 907, respectively. The gate 908, the gate 909, and the gate 910 may control the on and off of the transistor 905, the transistor 906, and the transistor 907, respectively. In this way, we not only can adjust the current of the individual LED string, but can also selectively close the individual LED string. Designers can use these transistors to adjust and control the required color temperature and current-color temperature curve. Pulse width modulation (PWM) can also be achieved by controlling the gate 908, the gate 909, and the gate 910. When the pulse width modulation is performed, gate 908, the gate 909, and the gate 910 are controlled in accordance with the control signal. The transistor 905, the transistor 906, and the transistor 907 are thus controlled to adjust the brightness of the LED string. In some embodiments, the color temperature may be varied with the duty cycle of the pulse width modulation. In other words, as the brightness increases or decreases, the color temperature can also be changed.

Figure 10A:
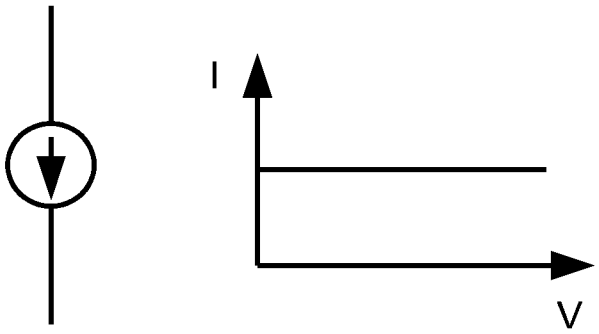
FIG. 10A illustrates a regulator and a current-voltage curves according to an embodiment of the present disclosure.
Figure 10B:
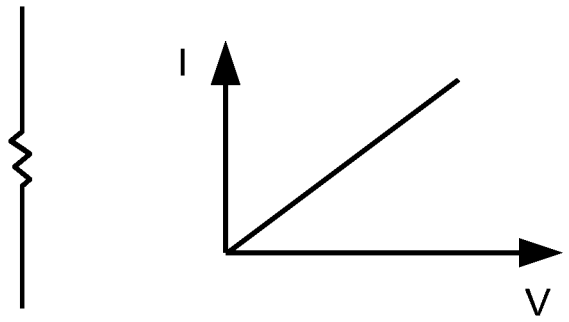
FIG. 10B illustrates a regulator and a current-voltage curves according to another embodiment of the present disclosure.
Figure 10C:
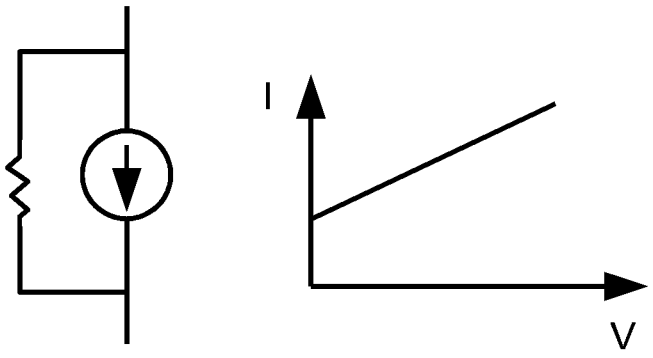
FIG. 10C illustrates a regulator and a current-voltage curves according to another embodiment of the present disclosure.
Figure 11A:
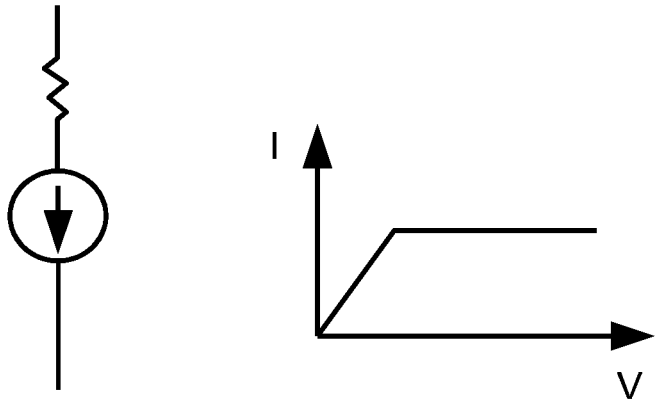
FIG. 11A illustrates a regulator and a current-voltage curves according to another embodiment of the present disclosure.
Figure 11B:
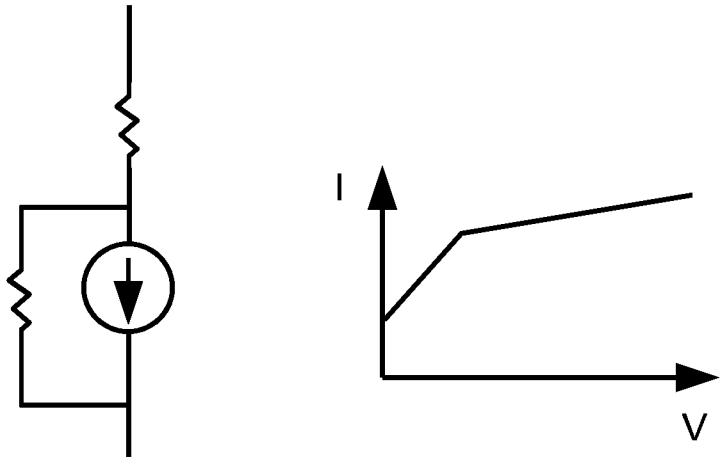
FIG. 11B illustrates a regulator and a current-voltage curves according to another embodiment of the present disclosure.
Figure 11C:
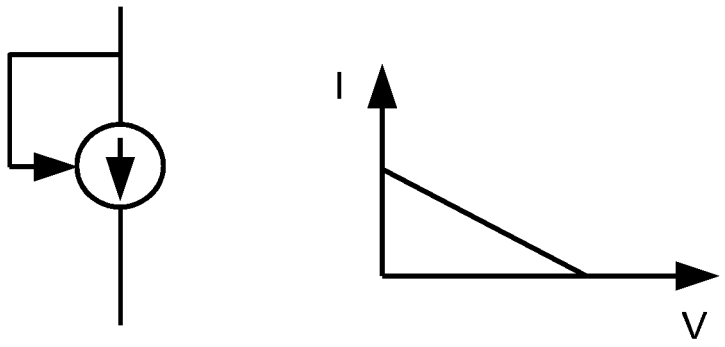
FIG. 11C illustrates a regulator and a current-voltage curves according to another embodiment of the present disclosure.

FIG. 10A illustrates an embodiment of a regulator and a current-voltage curve. FIG. 10B illustrates another embodiment of a regulator and a current-voltage curve. FIG. 10C illustrates another embodiment of a regulator and a current-voltage curve. FIG. 11A illustrates another embodiment of a regulator and a current-voltage curve. FIG. 11B illustrates another embodiment of a regulator and a current-voltage curve. FIG. 11C illustrates another embodiment of a regulator and a current-voltage curve. Referring to FIG. 10A, FIG. 10B, FIG. 10C, FIG. 11A, FIG. 11B and FIG. 11C, the ideal regulator is a constant current supply, but in order to be able to properly adjust the current and voltage characteristics curve of the output regulator, a resistor can be added to the constant current supply. The resistor can be selected as connected with the ideal constant current supply in parallel or in parallel. Different resistor connections and different transistor connections can cause different current and voltage characteristics curves. In some embodiments, the resistor may be a variable resistor, allowing the designer to adjust the desired color temperature and current-color temperature curve more flexibly.

With the above-described embodiments, one or more of the above-mentioned technical problems can be solved according to different technical characteristics.

While the present disclosure has been described with respect to the embodiments described above, those skilled in the art should be able to make appropriate substitutions or modifications in accordance with the foregoing description, including eliminating one element or adding elements, all should fall within the scope of the present disclosure.

What is claimed is:

1. An LED circuit with color temperature adjustment, comprising:

a first LED string group, comprising a first LED string and a second LED string, both the first LED string and the second LED string having a first color temperature;

a second LED string group, comprising a third LED string and a forth LED string, both the third LED string and the forth LED string having a second color temperature; and a switch assembly, for controlling switching between a serial and parallel connection of the first LED string and the second LED string, and controlling either a serial or parallel connection of the third LED string and the forth LED string;

wherein the second color temperature is higher than the first color temperature.

2. The LED circuit with color temperature adjustment of claim 1, further comprising a regulator module, the regulator module providing a first current to the first LED string, and providing a second current to the second LED string.

3. The LED circuit with color temperature adjustment of claim 1, wherein the first LED string and the second LED string are connected in parallel, and the third LED string and the fourth LED string are connected in series.

4. The LED circuit with color temperature adjustment of claim 1, wherein the first LED string and the second LED string are connected in series, and the third LED string and the fourth LED string are connected in parallel.

5. An LED circuit with color temperature adjustment, comprising:

a first LED group, comprising a first LED string and a second LED string, the first LED string being provided with a first color temperature, the second LED string being provided with a second color temperature;

a second LED string group, comprising a third LED string and a forth LED string, the third LED string being provided with a third color temperature, the forth LED string being provided with a forth color temperature; and a switch assembly, for controlling switching between a serial and a parallel connection of the first LED string and the second LED string, and controlling switching between a serial and parallel connection of the third LED string and the forth LED string;

wherein the first color temperature is different from the second color temperature, the third color temperature is different from the fourth color temperature.

6. The LED circuit with color temperature adjustment of claim 5, wherein the first LED string and the second LED string are connected in parallel, the third LED string and the fourth LED string are connected in series.

7. The LED circuit with color temperature adjustment of claim 5, wherein the first LED light string, the second LED light string, the third LED string and the fourth LED string are connected in parallel.

8. The LED circuit with color temperature adjustment of claim 5, wherein the first LED string and the second LED string are connected in series, and the third LED string and the fourth LED string are connected in series.

9. The LED circuit with color temperature adjustment of claim 5, further comprising a switch module, for controlling a pulse width modulation of the first LED group and the second LED group.

* * * * *